US005312646A

United States Patent [19]

Barbee et al.

[11] Patent Number: 5,312,646

[45] Date of Patent: May 17, 1994

[54] METHOD FOR MANUFACTURING PHOTOGRAPHIC MATERIAL

[75] Inventors: Eugene H. Barbee; Kathleen A. Bonsignore, both of Rochester; Wilbur S. Gaugh, Webster; Christopher J. Klasner, Rochester; Avonelle L. Leonard, Rochester; Daniel G. Ocorr, Rochester, all of N.Y.

[73] Assignee: Eastman Kodak Company, Rochester, N.Y.

[21] Appl. No.: 661,770

[22] Filed: Feb. 27, 1991

[51] Int. Cl.[5] ..... G03C 1/74

[52] U.S. Cl. ..... 427/177; 430/621; 430/935; 427/179; 427/374.1; 427/377; 427/378; 427/379; 427/381; 427/382

[58] Field of Search ..... 430/495, 935, 621; 427/177, 179, 374.1, 379, 381, 382, 377, 378

[56] References Cited

U.S. PATENT DOCUMENTS

| | | | |
|---|---|---|---|
| 2,627,088 | 2/1953 | Alles et al. | 430/171 |
| 3,063,838 | 11/1962 | Jennings | 430/639 |
| 3,939,000 | 2/1976 | Arvidson, Jr. et al. | 430/502 |
| 4,141,735 | 2/1979 | Schrader et al. | 96/75 |
| 4,301,238 | 11/1981 | Miyazawa et al. | 430/495 |
| 4,946,769 | 8/1990 | Arai et al. | 430/539 |
| 5,061,611 | 10/1991 | Sakata et al. | 430/533 |
| 5,096,803 | 3/1992 | Kanetake et al. | 430/349 |

FOREIGN PATENT DOCUMENTS

| | | | |
|---|---|---|---|
| 5469173 | 11/1977 | Japan . | |
| 0069173 | 6/1979 | Japan | 430/935 |
| 6059345 | 10/1983 | Japan . | |
| 63-179359 | 1/1987 | Japan . | |
| 62-81636 | 4/1987 | Japan . | |
| 62-81637 | 4/1987 | Japan . | |
| 62-280835 | 12/1987 | Japan . | |
| 63-026654 | 2/1988 | Japan . | |
| 3179359 | 7/1988 | Japan | 430/935 |

*Primary Examiner*—Lee C. Wright
*Attorney, Agent, or Firm*—Carl F. Ruoff

[57] ABSTRACT

Photographic materials, such as films and papers, include a support and coatings on the support. The coatings often contain hardeners which cause gelation cross links in the binder in the coating. The extent to which the cross-links have formed at the time of processing of the film or paper affects the appearance of the image produced by processing. Conventionally the cross-links have been allowed to form with time in normal atmospheric conditions. According to the invention, the formation of the cross links is accelerated to substantial completion by a process including incubating the material at a temperature above the glass transition temperature of the coating and below the melting point of the coating in an atmosphere having a relative humidity which causes a moisture content of the coating of 0.1 to 0.25 for a period of time sufficient to substantially complete the hardening, that is, the formation of the cross-links. Such period of time is less than ten minutes and can, with some materials and conditions, be as short as a minute or less. After the incubation step, the temperature of the coating is reduced below its glass transition temperature, the moisture content is reduced and the coating is then cooled prior to windup of the support with the coating thereon. The incubation and related steps of the invention may be performed after the coating and drying of the material and prior to windup into a roll or they may be performed in a rewind situation. A rewind situation is one in which a support has been coated and the coated support has been dried, cooled and wound up into a roll. The roll is subsequently unwound, operated upon in accordance with the invention and then rewound into a roll. After treatment in accordance with the invention, the roll of photographic material may immediately be tested and certified and passed to further operations in which it is cut into sizes usable by the consumer. Apparatus for performing the invention is also disclosed.

16 Claims, 3 Drawing Sheets

METHOD FOR MANUFACTURING PHOTOGRAPHIC MATERIAL

FIELD OF THE INVENTION

Photographic materials, such as, for example, photographic films and papers, are known which include layers of compositions which contain binders, particularly gelatin, which can be cross-linked (hardened) by various inorganic and organic compounds. Such layers are carried by a support such as, for example, cellulose acetate, polyethylene terephthalate, or paper, having been coated thereon. The present invention relates to method of and apparatus for manufacturing photographic material and, more particularly, but not exclusively, to a process and apparatus for accelerating the chemical cross linking of the binders, particularly the gelatin binders, used in photographic material.

BACKGROUND OF THE INVENTION

In the photographic manufacturing industry, it has long been known that the molecular structure of coatings using various natural or synthetic water-permeable hydrophylic polymers, such as gelatin, as vehicles or binders is very complex and dependent on the conditions used to dry the coatings. During setting, the coating liquids are cooled so that the coating turns into a semirigid solid, sometimes termed a gel. Gelation of the coating results from the formation of weak physical cross-links, known as van der Waals cross-links, between the gelatin molecules. To obtain the desired physical and photographic properties, these gel cross-links must not be allowed to be destroyed by melting during the subsequent drying process. Such weak cross-links are easily destroyed by raising the temperature during drying. However, when the coating is properly dried, these weak cross-links are still maintained in the material. It is believed that these weak physical cross-links contribute to the physical properties of the material being produced.

A second important structural parameter of the dried gelatin coating is the glass transition temperature (Tg). Below this temperature, the gelatin molecules are quite rigid and subject to very little thermal agitation. The material is said to be in a "glassy" state. Above this temperature, some of the rigidity of the molecules is lost as the molecules become thermally agitated.

Both the temperature at which the physical cross-links are destroyed and the glass transition temperature are highly dependent on the moisture content. Gelatin is a moderately hygroscopic material. Coatings of gelatin which are in equilibrium with an ambient environment may contain as much as 15 percent water. It is known that the gel melting point, Tm, and the glass transition temperature, Tg, at moderately high moisture content are closely related variables. The molecular agitation above the glass transition temperature would be expected to destroy a portion of the weak physical cross-links, and thus degrade the desired molecular structure of the coating which had been produced by drying the coating at low temperature. While investigating the relationship between gel melting point and glass transition temperature at relatively high temperature and moisture content, it has been found that the chemical hardening reaction could be accelerated to a much greater extent than was thought possible based on previous studies of the effect of storage temperature on the rate of the afterhardening reaction. Furthermore, by choosing the proper combination of temperature and moisture content, acceptable gel structure can be maintained.

The polymeric vehicles or binders are customarily cross linked (hardened) by various organic and inorganic compounds such as those described by T. H. James, *The Theory of the Photographic Process,* which are often termed hardeners. Hardeners are used to control the amount of swelling which occurs in the layers of the photographic material when it is processed in one or several solutions in order to develop the photographic image from the latent image. In some development processes the binders would dissolve in the processing solutions if they were not hardened before processing. Usually hardening of the binders is accomplished by adding the hardeners to one or more of the liquid photographic emulsions or other layers before they are coated onto the support. The cross-linking reaction starts as the coating is being dried and continues for a long period, often months, after coating and drying. Such hardening after drying and over the long term is often referred to as afterhardening. The rate of the afterhardening reaction is dependent on the temperature and moisture content of the material. Often the hardening reaction is not complete when the photographic material is developed after exposure. More importantly, the photographic response of the material is dependent on the degree to which the hardening reaction has progressed at the time the material is processed. For example, the amount of developer which permeates into the coating when the material is immersed in developer solution is dependent on the degree of hardening which has occurred at this time. This, in turn, influences the rate and extent of the reaction between the silver halide crystals and the developing agents. The problems derived from variations in the extent of afterhardening are especially troublesome for testing and certifying the photographic response of the material during manufacture. Often the dried coated materials are held for some months before final testing and certification and release for customer use, to allow a meaningful certification of the photographic response.

Numerous attempts to accelerate the rate of the afterhardening reaction have been made in which more reactive hardening agents are used. While partially successful, highly reactive hardening agents are very difficult to handle during preparation of the liquid emulsion and coating of the prepared emulsion onto the support. Stagnant areas in the emulsion delivery lines and hopper cavities are very prone to become filled with semisolid hardened binder material which is impossible to flush out without dismantling the delivery lines and hoppers. Furthermore, such hardened binder material may become dislodged as slugs or particles during the coating operation and lead to defects in the coated product.

It has been proposed, for example in Japanese laid open to public inspection Patent Applications (Kokai) 62-81636 and 62-81637, to accelerate the hardening reaction by storing the photographic material at a higher temperature. In these laid open patent applications, the coated and dried photographic material is described as being heated to 40° C. before winding at the end of the machine and the wound rolls are held at this temperature during storage before slitting the rolls to widths used by customers. The time required to complete the hardening reaction was reduced to a few days by this process, but it has been found that the degree of hardening obtained is highly variable unless the temperature throughout the length and width of the rolls are very uniform. Such uniformity is very difficult to achieve in practice. Furthermore, hardening could not be further accelerated by increasing the temperature above 40° C. since to do so would physically damage the coatings in the wound roll.

It is to the solution of this problem of slow and highly variable afterhardening that this invention is directed.

SUMMARY OF THE INVENTION

It has been found that, by incubating a photographic material at a temperature above the glass transition temperature, Tg, of the coating and below the melting point, Tm, of the coating, in an atmosphere having a relative humidity which causes a moisture content (expressed as the ratio of the weight of water to weight of gelatin in the material) of the coating of 0.1 to 0.25 for a period of time sufficient to substantially complete hardening, the afterhardening reaction can be substantially completed without unacceptable change in the molecular structure of the material. It has been found that by appropriate selection of temperature and relative humidity, the duration of such incubation may be less than 10 minutes for many materials and as little as a minute or less for some materials. It will be understood by those skilled in the art, that a process step having a duration in such a range is accommodatable in a coating line. At temperatures below the glass transition temperature and with moisture contents below the aforesaid range, the time required to achieve substantially complete hardening reaction is increased substantially. For example, at 40° C. with ambient humidity, as discussed in Japanese Kokais 62/81636 and 62/81637, it was found that several days were required. At temperatures above those specified, the structure of the gelatin molecules formed during drying of the coating is changed to such an extent that the material cannot be used by the consumer.

According to one aspect of the present invention there is provided a method of manufacturing a photographic material which includes providing a continuous web like support, coating the support with a photographic composition including binder and hardener and drying the coating on the support, which steps may be in accordance with the prior art. The method according to the invention includes ensuring that the moisture content of the coating is sufficiently low that at temperatures subsequently to be encountered in the manufacturing method gelation cross-links will not be remelted. The coating is then heated in an atmosphere having a relative humidity sufficiently low as to avoid condensation on the coating, towards the temperature of the ensuing incubation step. The heated coating is then, in accordance with the invention, incubated at a temperature above the glass transition temperature of the coating and below the melting point of the coating, in an atmosphere having a relative humidity which causes a moisture content of the coating of 0.1 to 0.25 for a period of time sufficient to substantially complete hardening. The support and coating are thereafter cooled and the cooled support and coating thereon are then wound into a roll.

The moisture content of the coating may be reduced, before winding up, so that it is in equilibrium with the atmosphere, ambient at the time of winding up, having a relative humidity of about 50%.

In some embodiments, immediately after exiting the incubation step the coating is subjected to post cooling in which the temperature of the coating is reduced below the glass transition temperature in a manner that does not degrade the physical properties of the coating. This may be performed by directing air at ambient temperature and humidity onto the coating for about one to five seconds.

As a preferred embodiment of this invention, the dried coating is treated at the above-specified conditions in a special treatment zone near the end of the coating machine before the coated material is wound. In such a preferred embodiment, the coated support is not wound up before it is subjected to the incubation and other steps of the present invention.

In other embodiments, the support is coated, dried and wound up in what may be a conventional manner and the novel steps of the present invention are performed in what may be termed a rewind situation. The coated, dried and wound up material is unwound and subjected to the novel incubation and other steps of the present invention and is then wound up again into a roll.

In some embodiments of the invention, particularly those in which after the end of the drying step there is a moisture content gradient through the depth of the coating, with the greater moisture content being adjacent the support, the step of ensuring that the moisture content of the coating is sufficiently low includes performing the drying step until the surface of the coating is so dry that, after termination of the drying step, moisture migrating from the higher moisture content region of the coating adjacent the support causes regions at all depths into the coating from the free surface to have a moisture content below that at which remelting of gelation cross-links would be induced in the ensuing incubation step.

According to another aspect of the present invention, there is provided apparatus which includes means for incubating the coating of photographic composition on a continuous support. The incubating means holds the temperature of the coating above the glass transition temperature of the coating and below the melting point of the coating, in an atmosphere having a relative humidity which causes a moisture content of the coating of 0.1 to 0.25 for a period of time sufficient to substantially complete hardening.

The incubating means may be disposed in a coating line, that is, in a machine which has unwinder means for unwinding a continuous support from a roll, a coating device for coating the composition, including binder and hardener, onto the support, and drying means for drying the coating. The machine incubates the dried coating before it arrives at a windup.

Alternatively, the incubating means may be included in a rewind situation in which a roll of photographic material including a continuous support bearing a coating of composition which has been dried, is unwound, passed through the incubating means and then wound up again.

DESCRIPTION OF THE PREFERRED EMBODIMENTS

Figure 1:
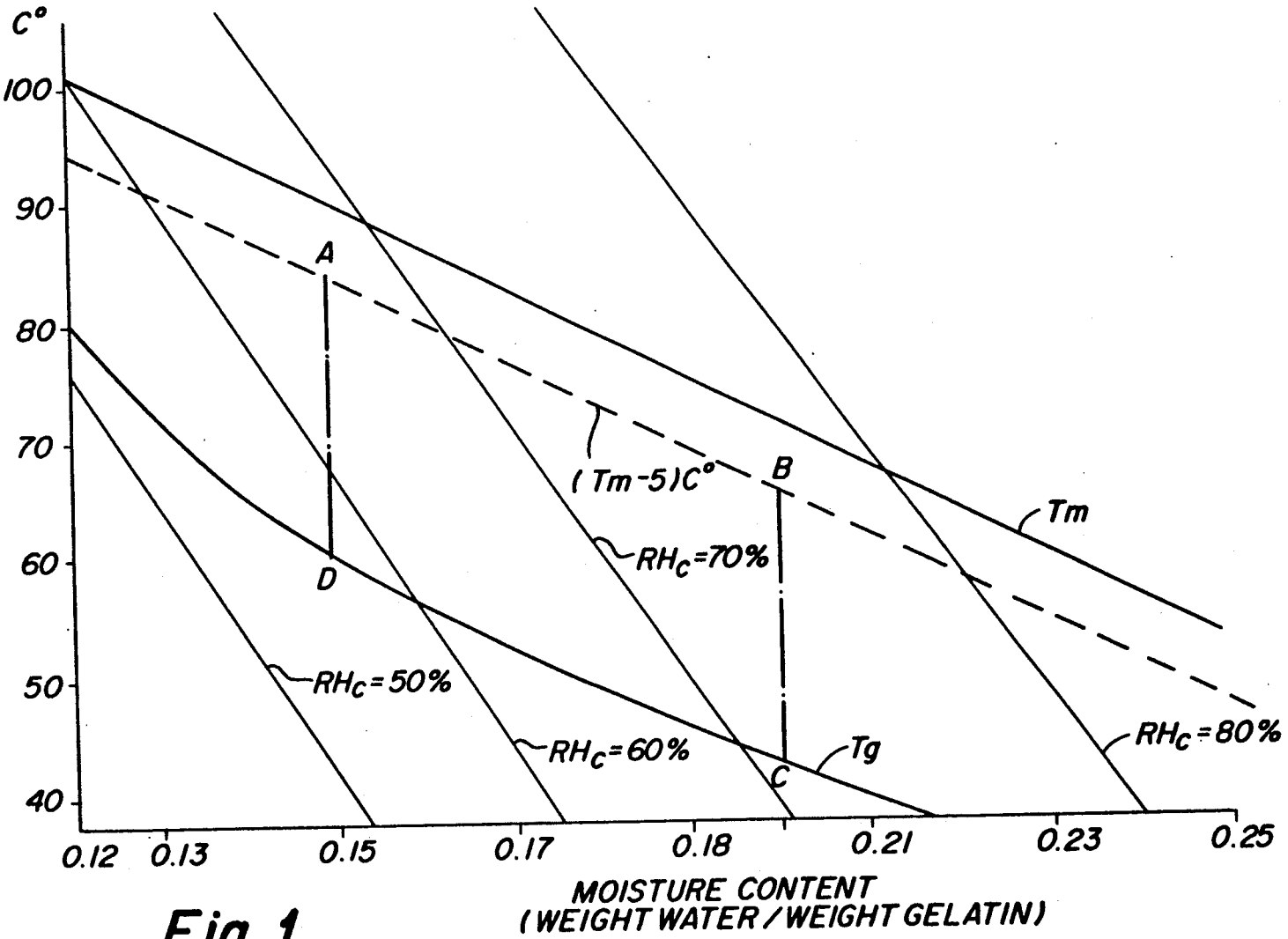
FIG. 1 is a graph showing the relationship between temperature and moisture content and the glass transition temperature (Tg) and gel melting point (Tm) for a coating of a typical photographic material.

FIG. 1 is a graph showing how the glass transition temperature Tg and melting point Tm of the gelatin in the photographic material vary with temperature and moisture content of the coating.

In FIG. 1, the temperature is plotted as the ordinate and moisture content as the abscissa. Also shown on this graph are lines $RH_c$ of constant relative humidity ($RH_c$=50%; 60%; 70%; and 80%) of the air which is in equilibrium with the gelatin in the material. Note that, as the temperature is increased at constant relative humidity, the amount of moisture in the coating decreases. Also, the amount of moisture increases as the relative humidity is increased at constant temperature.

As shown in FIG. 1, the glass transition temperature Tg and the gel melting point Tm both decrease as the moisture content is increased. Note that the glass transition temperature Tg is 20° to 30° C. lower than the gel melting point Tm when the moisture content is held constant, and up to 50° C. lower when the relative humidity is held constant.

At a constant product moisture content Tg can vary from about 60° C. to 80° C. depending on the formulation of the coating and Tm can vary from about 80° C. to 100° C. again depending on the formulation of the coating.

While the temperature must be kept below the melting point Tm, in actual manufacturing conditions it may be found desirable, with some materials, to keep the temperature at least 5 centigrade degrees below the melting point. A broken line at (Tm−5)° C. is included in FIG. 1. If the temperature were to be allowed to go higher than this, then the physical properties of the coating might begin to deteriorate and the photographic material might not be satisfactory for customer use. If the temperature is lower than the glass transition temperature, the gelatin molecules being quite rigid, the time for substantially complete hardening to occur in the incubation step is excessive and the process cannot, practically, be performed on line.

It was also found that hardener efficiency is increased by the use of the present invention. The term hardener efficiency as used herein is defined as the amount of hardening agent required to obtain a certain degree of cross linking of the gelatin in the material when treated according to the present invention divided by the amount of hardening agent required to obtain the same degree of hardening when the material is not treated in accordance with the present invention. It has been found that when manufacturing some materials with methods according to the present invention, as little as 65% of the hardener needed without the present invention, may yield satisfactory product. With many materials it is found that 75 to 95% will suffice. It is believed that the hardener used with the previously known production processes, but not needed when practicing the present invention, is only partially reacted and is responsible for much of the long term drift of the photographic properties of the material. Thus, the present invention not only completes the hardening reaction in a very short time but also reduces the amount of hardener required. It thereby reduces the possibility of further, long-term hardening reactions during storage of the material before customer use, as well as permitting much more accurate prediction of suitability for use at the time the customer uses it.

Figure 2:
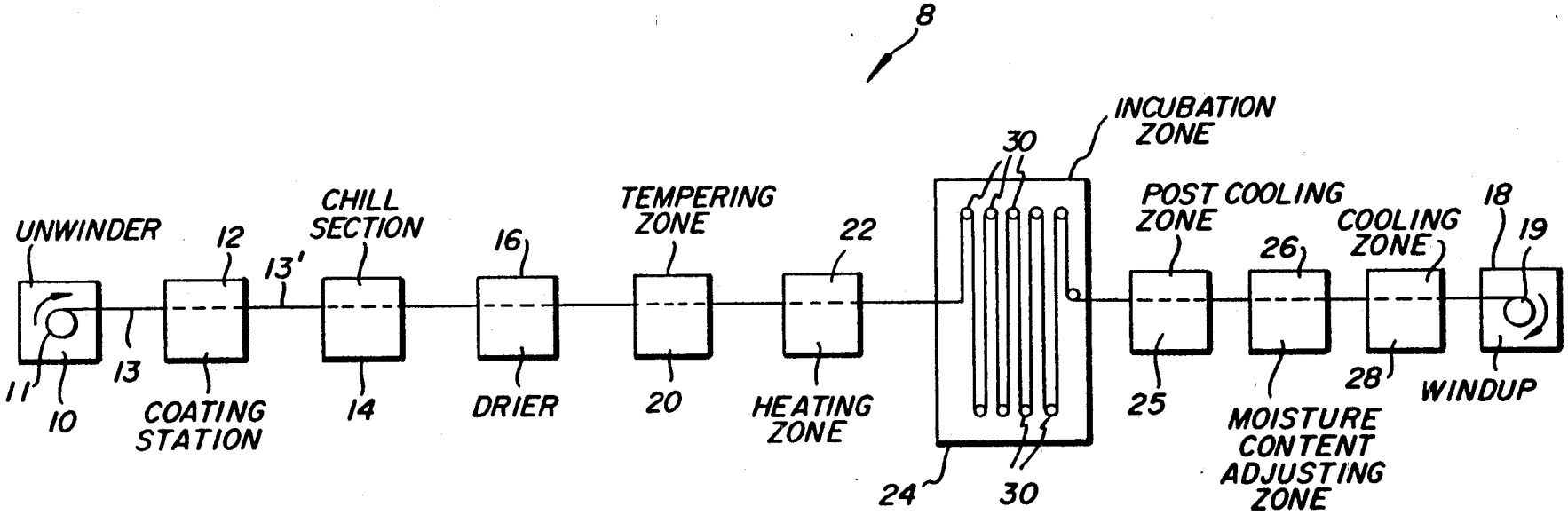
FIG. 2 is a schematic drawing of a coating machine showing the several zones used to treat the dried coating before the web is wound at the end of the machine, according to this invention.

FIG. 2 shows in schematic form a coating machine 8 suitable for performing a method in accordance with the present invention so as to complete substantially the afterhardening reaction before the material is wound at the end of the machine. The components of the machine 8 which may be of known form and which perform steps in accordance with the prior art, will be described first. Such prior art components include an unwinder 10 for supporting and unwinding a stock roll 11 from which extends a web of support 13; a coating station 12 from which progresses the coated support 13'; a chill section 14 wherein the coating applied by the coating station is gelled to a semi rigid solid; a drier 16 wherein the coated support 13' is dried; and a windup 18 in which the dried web 13' is wound up again into the form of a roll 19. To practice one embodiment of the present invention, the following additional components or zones are included in the coating machine: a tempering zone 20, a high-temperature heating zone 22, an afterhardening reaction, incubation zone 24, a post cooling zone 25, a moisture content-adjusting zone 26 and a cooling zone 28.

In practicing the prior art, after being unwound at the unwinder 10, the support 13 is led to and through the coating station 12 at which it is coated with a layer, which may be formed of a plurality of layers, of coating composition or compositions including gelatin and hardener. The coated support 13' passes on to the chill section 14 which is operated at a relatively low temperature in the range of −10° C. to +10° C., where the gelatin binder in the coating forms physical, gelation cross-links and the coating becomes a semirigid solid. The drier 16, which follows the chill section 14, is used to remove substantially all of the water in the coating. The drier 16 uses air with low moisture content to dry the coating and is operated at a moderate temperature in the range of 20° C. to 40° C. so as not to melt the gelation cross-links. Usually it is necessary to adjust the moisture content of the dried coating before windup to bring it into equilibrium with an atmosphere of about 50% relative humidity. This is normally accomplished in the windup end of the machine 8 by allowing the material to adjust to the relative humidity in the windup area which is normally operated at approximately 50 percent relative humidity.

In practicing the present embodiment of the invention, the drier 16 is immediately followed by the tempering zone 20 in which the moisture level of the coating near the interface with the support is reduced. It has been found that with many materials in which, at the nominal dry point of the coating, there was still too much moisture in the gelatin near the support. If the coating were to be heated to the temperature required to accelerate the hardener reaction, in accordance with the present invention, before the moisture level had been reduced, the gelation cross-links would be partially remelted. Thus, it is necessary to ensure that regions at all depths of the coating away from the free surface of the coating, namely both at the free surface and at the interface with the support, are sufficiently dry that the gelation cross-links in no region of the coating are even partially remelted in the ensuing incubation step. This may be achieved by overdrying the coating in the drier 16 and then having a dwell period in which the moisture adjacent the support migrates to the overdried free surface region of the coating. Such migration brings the moisture content of the gelatin near the support down to a value at which the gelation cross-links will not be remelted in the ensuing heating step. At the same time the moisture which has migrated towards the free surface of the coating does not take the moisture content of that region of the coating above the threshold value at which gelation cross-links start to remelt in the ensuing heating step. Thus, in the present embodiment of the invention, the tempering zone 20 is a dwell zone in which there is migration of moisture so as to be certain that the region of the coating at the support interface has been adequately dried for treatment in the high temperature zone. Usually only a few seconds of treatment time are required in the tempering zone 20. Thus, in the present embodiment of the invention, the step of ensuring that the moisture content of the coating is sufficiently low that at temperatures subsequently to be encountered in the manufacturing method gelation cross-links will not be remelted, is fulfilled by the afore-described overdrying in the drier and by the dwell in the tempering zone 20.

There may be manufacturing situations in which, after drying, there are not regions, in the coating, in which the moisture content is so high that gelation cross-links would be remelted in the ensuing method steps. In such situations, the step of ensuring that the moisture content of the coating is sufficiently low that at temperatures subsequently to be encountered in the manufacturing method gelation cross-links will not be remelted, may not entail overdrying and the provision of any special zone in the production line, but may be performed at the time of designing the production machine.

As discussed above, the conditions must be such that the coating is above the glass transition temperature Tg but below the melting point Tm for performing the incubation step of the present invention. Below the glass transition temperature the molecular mobility of the gelatin and the kinetic reaction rate of the hardener are so reduced that the time needed for the achievement of substantially complete hardening is excessive. Above the melting point Tm, the material is damaged. As is shown in FIG. 1, both of these transition temperatures are very much dependent on the moisture content of the material.

Following the tempering zone 20, the coating is heated in the heating zone 22, as rapidly as possible, to a temperature above the dew point in the reaction zone 24 and, preferably, to the temperature in the reaction zone. The relative humidity of the air is purposely kept low in the heating zone 22 in order to make certain that there is no possibility of remelting the gelation cross-links as the coating is heated. The low relative humidity also ensures that there is no possibility of moisture:condensing on the coating at the beginning of the heating process. The dew point of the air used to heat the coating should be below the temperature of the coated support 13' as it enters the heating zone 22. Preferably, the heating zone 22 is designed for high velocity air impingement similar to that used in the drier so that the time required to heat the support and coating is only a few seconds. The coating will continue to dry in this zone, and it has been found desirable with certain coatings to minimize such overdrying before the coated support enters the next zone.

The coated support now enters the reaction zone 24 where the incubation occurs and the chemical cross-linking of the coating is substantially completed. It has been found that, if the hardening is at least 85 percent complete before the material is wound at the end of the coating machine, then the photographic material can be tested and certified for customer use with highly predictable photographic response for a period of many months to a few years after the material is manufactured. Thus, "substantially complete", as used herein, means that the cross-linking reaction is at least 85 percent complete before the material is wound at the end of the machine.

While, in accordance with the present invention the temperature in the reaction zone is between the glass transition temperature and the melting point of the coating and the relative humidity is such as to cause a moisture content in the coating of 0.1 to 0.25, in a preferred embodiment with a particular material, the conditions of air temperature and relative humidity in the reaction zone are such that the coating in the reaction zone is held to a temperature in the range of Tg to (Tm−5)° C. and a moisture content in the range of 0.15 to 0.2. Such conditions are defined by the window ABCD in FIG. 1. It has been found that such conditions are an optimization of capital and operating costs and incubation time. It will be recognized by those skilled in the art that as the temperature of the reaction zone is increased so is the cost of insulation if the running costs are to be minimized. Also, the steam needed increases greatly as the relative humidity level is increased and thus the capital and the running costs both increase greatly. The optimum or preferred conditions will vary for different photographic materials, depending on the type of binder used and the kind and amount of hardener or other addenda added to the composition to be coated. For example, plasticizers are often added to improve the flexibility of the coating and are known to influence the glass transition temperature and melting point.

The thermal agitation of the gelatin molecules above the glass transition temperature is increased by several orders of magnitude. Consequently, the rate of the hardening reaction is increased substantially for all hardening agents.

The present invention can be used with all hardening agents customarily used in photographic materials ( with an exception mentioned hereinafter), such as those described by T. H. James, *The Theory of the Photographic Process*, 4th Ed., MacMillan, 1977, pp 77–87. The hardeners can be used alone or in combination and in free or in blocked form. Typical useful hardeners include formaldehyde and free dialdehydes such as succinaldehyde and glutaraldehyde, as illustrated by Allen et al U.S. Pat. No. 3,232,764; blocked dialdehydes, as illustrated by Kaszuba U.S. Pat. No. 2,586,168, Jeffreys U.S. Pat. No. 2,870,013 and Yamamoto et al U.S. Pat. No. 3,819,608; α-diketones, as illustrated by Allen et al U.S. Pat. No. 2,725,305; active esters of the type described by Burness et al U.S. Pat. No. 3,542,558; sulfonate esters, as illustrated by Allen et al U.S. Pat. Nos. 2,725,305 and 2,726,162; active halogen compounds, as illustrated by Burness U.S. Pat. No. 3,106,468, Silverman et al U.S. Pat. No. 3,839,042, Ballantine et al U.S. Pat. No. 3,951,940 and Himmelmann et al, U.S. Pat. No. 3,174,861; s-triazines and diazines, as illustrated by Yamamoto et al U.S. Pat. No. 3,288,775 and Stauner et al U.S. Pat. No. 3,992,366; epoxides, as illustrated by Allen et al U.S. Pat. No. 3,047,394, Burness U.S. Pat. No. 3,189,459 and Birr et al German Patent 1,085,663; Aziridines, as illustrated by Allen et al U.S. Pat. No. 2,950,197, Burness et al U.S. Pat. No. 3,271,175 and Sato et al U.S. Pat. Nos. 3,490,911, 3,539,644 and 3,841,872 (Reissue 29,305), Cohen U.S. Pat. No. 3,640,720, Klein et al German Patent 872,153 and Allen U.S. Pat. No. 2,992,109; blocked active olefins, as illustrated by Burness et al U.S. Pat. No. 3,360,372 and Wilson U.S. Pat. No. 3,345,177; bis-(vinylsulfonylmehtyl)ether as illustrated by Burness at al U.S. Pat. No. 3,642,486; carbodiimides, as illustrated by Blout et al German Patent 1,148,446; isoxazolium salts unsubstituted in the 3-position, as illustrated by Burness et al U.S. Pat. No. 3,321,313; esters of 2-alkoxy-N-carboxydihydroquinoline, as illustrated by Bergthaller et al U.S. Pat. No. 4,013,468; N-carbamoyl and N-carbamoyloxypyridinium salts, as illustrated by Himmelmann U.S. Pat. No. 3,880,665 and Himmelmann U.S. Pat. No. 4,063,952; heteroaromatic vinylsulfones and precursors as illustrated in Ohlschlager et al U.S. Pat. No. 4,840,890, Himmelmann et al U.S. Pat. No. 4,845,024, and Himmelmann et al U.S. Pat. No. 4,894,324, hardeners of mixed function, such as halogen substituted aldehyde acids (e.g., mucochloric and mucobromic acids), as illustrated by White U.S. Pat. No. 2,080,019, 'onium-substituted acroleins, as illustrated by Tschopp et al U.S. Pat. No. 3,792,021, and vinyl sulfones containing other hardening functional groups, as illustrated by Sera et al U.S. Pat. No. 4,028,320; bis(vinylsulfonylacetamido) ethane, either alone or in combination with polystyrenesulfinic acid and glycerol as illustrated in Ogawa et al U.S. Pat. No. 4,444,926; dictation ether as illustrated in Chen et al U.S. Pat. No. 4,877,724; and polymeric hardeners such as dialdehyde starches, as illustrated by Jeffreys et al U.S. Pat. No. 3,057,723; and co-poly (acrolein methacrylic acid), as illustrated by Himmelmann et al U.S. Pat. No. 3,396,029. It can also be used with hardeners in combination as illustrated by Sieg et al U.S. Pat. No. 3,497,358, Dallon et al U.S. Pat. Nos. 3,832,181 and 3,840,370 and Yamamoto et al U.S. Pat. No. 3,898,089. Hardening accelerators can be used, as illustrated by Sheppard et al U.S. Pat. No. 2,165,421, Kleis German Patent 881,444, Riebel et al U.S. Pat. No. 3,628,961 and Ugi et al U.S. Pat. No. 3,901,708.

It will be recognized by those skilled in the art that hardeners which thermally degrade or are excessively volatile at the temperatures to be encountered in the incubation zone should not be used when the present invention is employed.

The time required to:complete substantially the hardening reaction with the preferred treatment conditions in the reaction zone 24 stated above, is less than ten minutes and can, with some materials and conditions, be as short as a minute or less. Thus, with the present invention there is no longer any need to use highly reactive hardeners to accelerate the rate of the afterhardening reaction. However, such highly reactive hardeners may be used in embodiments of the present invention. The treatment time varies with the particular combination of air temperature and relative humidity used in the reaction zone. If the required treatment time is longer than 3 to 4 minutes, then it often is possible to raise either the temperature and/or the relative humidity in order to decrease the treatment time into this range.

In the reaction zone 24, it is not necessary to direct a high velocity flow of air on the coating. The reaction zone should have a moderate circulation of air which preferably is recirculated. The air-recirculation volume (cubic meters per second) should be at such a rate that the air is turned over (changed) in the reaction room about 20 times per hour. It will be necessary to heat the recirculated air continuously to make up for the heat losses from the reaction zone. The coating will also absorb moisture from the recirculating air as it adjusts its moisture content so that it is in equilibrium with the recirculating air in the reaction zone 24. This will require the addition of moisture to the recirculating air. To provide the required treatment time, the coated support 13' is passed over a series of rollers 30, as indicated schematically in FIG. 1. Some or all of the rollers may be replaced by air-flotation turning bars, in which case some or all of the recirculating air can be introduced through the air-turning bars. The required length of thread up in the reaction zone can be calculated by multiplying the required treatment time by the coating speed.

After exiting the reaction zone 24, the coated support 13' enters the post cool zone 25 in which the temperature of the coating is reduced below the glass transition temperature Tg in a manner that does not degrade the physical properties of the coating. It has been found that active impingement of air on the coating for one to five seconds at ambient temperature and relative humidity serves, in the cases of materials which have been tested, to reduce the temperature of the coating below Tg without degrading its physical properties.

In some circumstances a post cool zone is not required.

After exiting the post cool zone 25, or, in the absence of a post cool zone, after exiting the reaction zone 24, the coated support 13' enters the moisture content adjusting zone 26. In the reaction zone, the moisture content of the coating and support have come to equilibrium with the high relative humidity of the reaction zone 24. Such moisture content is too high to be present in a wound roll and must be lowered so that at windup it is in equilibrium with air at about 50 percent relative humidity at 22° C. This is accomplished in the moisture content adjusting zone 26 which is supplied with air at a temperature below the glass transition temperature Tg of the coating and at a low relative humidity, preferably in the range from 10 to 20% relative humidity. Preferably, the air is directed at the coating at a high impingement velocity similar to that used in the drier 16. The time required to adjust the moisture content will be in the range from 5 to 20 seconds and is dependent on the thickness and kind of support which is carrying the coating. Film supports generally will require a longer time than will paper supports. For film supports, the required time can be further shortened by impinging low-relative-humidity air on the uncoated side of the support as well as on the coated side.

The cooling zone 28 serves to cool the coated material to room temperature (20° to 25° C.) before it arrives at the windup 18. Such cooling can be accomplished in the normal windup end of the coating machine 8 by slightly lowering (when compared to a conventional manufacturing operation not in accordance with the present invention) the temperature of the air circulated to the room containing the windup 18. Such lowered temperature compensates for the heat content of the high-temperature photographic material 13' entering this room. Thus, it is to be understood that the cooling zone may be the room in which the windup 18 is situated and which the material enters after leaving the moisture content adjusting zone.

The material is wound into a roll 19 by the windup 18 and, by virtue of the present invention, may be taken directly, without storage for afterhardening to occur, to finishing operations and immediate subsequent sale to the user without concern that usage sooner or later will produce differing results.

It will be appreciated by those skilled in the manufacture of photographic material that the mode of carrying out the present invention described above has been designed to shorten the total time required to treat the material and substantially complete the hardening reaction without otherwise adversely affecting the material or physically damaging it, so that the invention may be practiced in line on a coating machine before the material is wound at the end of the machine.

Figure 3:
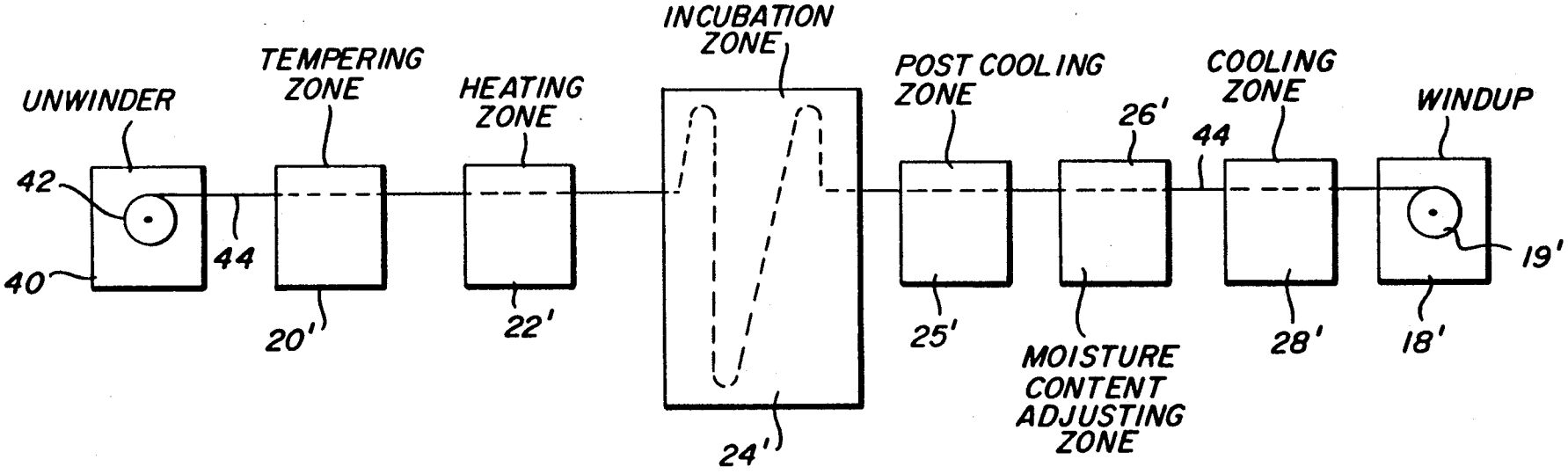
FIG. 3 is a schematic drawing, similar to FIG. 2, illustrating a second embodiment of the present invention.

In another embodiment of the present invention, the photographic material, having been wound up into a roll at the end of a conventional coating machine, is unwound, treated in accordance with the present invention and then wound up again. Such an embodiment of the invention may be performed in a modified rewinder. A conventional rewinder includes an unwinder and a winder. It is commonly used to inspect coated products for possible physical damage or to rewind rolls which have been poorly wound. By adding the above-described tempering zone, high temperature heating zone, hardening reaction, incubation zone, optional post cool zone, moisture content adjusting zone and cooling zone to the threadup between the unwinder and the winder, the photographic material previously coated and wound can be treated so as to complete substantially the hardening reaction in a manner otherwise identical to that described above. FIG. 3 is a diagrammatic representation of such an embodiment of the present invention. In FIG. 3 features are given the same reference numeral as the features to which they correspond in the first embodiment, illustrated in FIG. 2, but with the addition of a prime (') suffix. In FIG. 3 the unwinder is given the reference numeral 40. The roll of material coated on a conventional coating machine is given the reference numeral 42, and the web of coated support drawn off the roll 42 is given the reference numeral 44. For an understanding of the structure and operation of this second embodiment of the present invention, reference is directed to the description above of the first embodiment and to FIG. 2 wherein the first embodiment is illustrated.

It is to be understood that the tempering zone 20' need not be provided or used, if provided, if the moisture content of regions at all depths of the coating is sufficiently low, upon the material 44 being unwound by the unwinder 40, that gelation cross-links will not be remelted at the elevated temperatures to be encountered in the ensuing method steps. However, if it is needed to reduce the moisture content of the coating of the material being fed off the unwinder 40, this can be done by drying with air at slightly elevated temperature and reduced humidity.

The following examples further illustrate the invention.

EXAMPLE 1

A trial of the incubation treatment process of the present invention was made on a modified production machine. The term "pack" as used herein and in the photographic industry in this context, means a plurality of discrete layers disposed sandwich-fashion in mutual contact to form a single layer which is coated onto film or paper, possibly with previous or later packs, to form a photographic material. The discrete layers may contain different, or the same, compositions. The final (that is, the topmost) pack (yellow pack) of a Kodak Ektachrome (reversal type) Film was coated over the previously prepared film on which the first two packs (cyan and magenta packs) had already been coated. All of the hardener to be used in the film was added to the yellow pack. Two trial coatings were made. The first trial (Sample A) used the present invention, that is, the support and coatings were passed through zones corresponding to zones 20 through 28 in the first embodiment described above and illustrated in FIG. 2, while the second trial (Sample B) was conventional and bypassed zones and steps which were present for performance of the present invention. For Sample A, only 65 percent of the hardener used in Sample B, was used. The hardener used in both Samples was bis-vinyl sulfonyl methane (BVSM). The parameters in the reaction zone 24 for Sample A were as follows:

| | |
|---|---|
| Temperature | 65.5° C. |
| Relative humidity | 70% |
| Treatment time | 3 min |

The photographic speed (ER 100C) and maximum density (Dmax) of Samples A and B were measured, with results as follows, T being the number of days after coating:

TABLE 1

| | Sample A | | Sample B | |
|---|---|---|---|---|
| T | ER 100C | Dmax | ER 100C | Dmax |
| 0 | 196 | 3.08 | 211 | 2.67 |
| 1 | 193 | 3.10 | 200 | 2.97 |
| 2 | 193 | 3.12 | 196 | 3.12 |
| 4 | 193 | 3.03 | 193 | 3.03 |
| 20 | 193 | 3.03 | 193 | 3.03 |

The results of both the photographic speed and maximum density measurements indicate that Sample A substantially attained final Photographic response immediately after coating, while Sample B requires 2–4 days.

Other photographic materials made at the same time but using different levels of hardener and treatment times gave the following results when tested 1 day after coating:

TABLE 2

| Hardener Level* | Temperature °C. | Relative Humidity % | Time min | ER 100C | Dmax |
|---|---|---|---|---|---|
| 65 | 65.5 | 70 | 3 | 193 | 3.10 |
| 65 | 65.5 | 70 | 4 | 193 | 3.08 |
| 75 | 65.5 | 70 | 3 | 188 | 3.16 |
| 75 | 65.5 | 70 | 4 | 186 | 3.18 |
| 88 | 65.5 | 70 | 4 | 180 | 3.23 |

*as a % of normal volume

The results show the increased hardener efficiency achievable by adoption of the present invention. Increasing the hardener level above 65% of normal, when operating in accordance with the present invention, reduced the photographic speed and increased the maximum density, both of which are undesirable. Increasing the treatment time from 3 to 4 min had little or no effect, indicating that the hardening reaction is essentially complete after 3 min of treatment at 65.5° C. at 70% relative humidity.

In the following Examples 2 to 6, the experiments are conducted on KODACOLOR VR-G Gold 400 film having the reference number 5097.

From extensive analysis it was determined that the biggest sensitometric variability with natural age keeping (that is, without use of the present invention) occurs in the blue and red sensitive layers at step eighteen in a twenty step sensitometric test, that is, two steps below dmax. It is for this reason that the sensitometric values given in the tables in the following examples are for Step 18. In the tables in the following examples:

BD means Blue Density at step 18

RD means Red Density at step 18

The tables in the following Examples 2 to 6 contain sensitometric data against time for various incubation treatments and each table contains a control sample, Sample B, for comparison. The hardener used was BVSM in all cases.

In the following examples, by a hardener level of 1.0×is meant that the hardener used in Sample A is 100% of that used in Sample B. Similarly, a hardener level of 0.75 would be one which is 75% of that of Sample B.

Also, in the following examples, EL is the Enzymolysis Length which is a measure of hardness. A measurement of hardness, which includes measuring the Enzymolysis Length, is described in U.S. Pat. No. 4,877,724. Therein is a description of the test and how to derive hardness from the measurement of a length, the Enzymolysis Length, which is termed the wedge length in the formula. T is, again, the number of days after coating.

EXAMPLE 2

In this example, for Sample A the following parameters existed in the reaction zone 24:

| | |
|---|---|
| Temperature | 79° C. |
| Relative humidity | 60% |
| Treatment time | 2 minutes |
| Hardener level | 1.0x |

TABLE 3

| | EL | Sample A | | EL | Sample B | |
|---|---|---|---|---|---|---|
| T | (mm) | BD | RD | (mm) | BD | RD |
| 0 | 123 | 2.90 | 1.98 | 47 | 2.83 | 1.93 |
| 1 | 123 | 2.90 | 1.97 | 71 | 2.81 | 1.97 |
| 2 | 123 | — | — | 86 | — | — |
| 4 | 123 | 2.90 | 1.97 | 101 | 2.77 | 1.94 |
| 7 | 123 | 2.90 | 1.97 | 109 | 2.76 | 1.93 |
| 20 | 123 | 2.90 | 1.96 | 112 | 2.74 | 1.93 |

EXAMPLE 3

In this example, the following parameters existed for Sample A, again the sample treated in accordance with the present invention:

| | |
|---|---|
| Temperature | 63° C. |
| Relative humidity | 70% |
| Treatment time | 3.0 min |
| Hardener level | 0.75x |

TABLE 4

| | EL | Sample A | | EL | Sample B | |
|---|---|---|---|---|---|---|
| T | (mm) | BD | RD | (mm) | BD | RD |
| 0 | 74 | 2.64 | 2.01 | 47 | 2.83 | 1.99 |
| 1 | 86 | 2.65 | 2.01 | 71 | 2.81 | 1.97 |
| 2 | 86 | — | — | 86 | — | — |
| 4 | 86 | 2.65 | 2.01 | 101 | 2.77 | 1.94 |
| 7 | 86 | 2.65 | 2.01 | 109 | 2.76 | 1.93 |
| 20 | 86 | 2.65 | 2.01 | 112 | 2.74 | 1.93 |

EXAMPLE 4

In this example the following parameters existed for Sample A, again the sample treated in accordance with the present invention:

| | |
|---|---|
| Temperature | 63° C. |
| Relative humidity | 65% |
| Treatment time | 4.0 min |
| Hardener level | 0.75x |

TABLE 5

| | EL | Sample A | | EL | Sample B | |
|---|---|---|---|---|---|---|
| T | (mm) | BD | RD | (mm) | BD | RD |
| 0 | 82 | 2.70 | 2.00 | 56 | 2.73 | 1.94 |
| 1 | 84 | 2.73 | 2.00 | 78 | 2.70 | 1.92 |
| 2 | 85 | — | — | 92 | — | — |
| 4 | 86 | 2.73 | 2.00 | 100 | 2.67 | 1.90 |
| 7 | 89 | 2.73 | 2.00 | 112 | 2.65 | 1.89 |
| 20 | 92 | 2.73 | 2.00 | 114 | 2.65 | 1.89 |

EXAMPLE 5

In this example the following parameters existed for Sample A, again the sample treated in accordance with the present invention:

| | |
|---|---|
| Temperature | 79° C. |
| Relative humidity | 65% |
| Treatment time | 3.0 min |
| Hardener level | 0.5x |

TABLE 6

| | EL | Sample A | | EL | Sample B | |
|---|---|---|---|---|---|---|
| T | (mm) | BD | RD | (mm) | BD | RD |
| 0 | 64 | 2.77 | 1.97 | 61 | 2.74 | 1.99 |
| 1 | 64 | 2.78 | 1.95 | 87 | 2.71 | 1.97 |
| 2 | 65 | — | — | 100 | — | — |
| 4 | 66 | 2.78 | 1.95 | 110 | 2.67 | 1.95 |
| 7 | 66 | 2.78 | 1.95 | 113 | 2.65 | 1.94 |
| 20 | 67 | 2.78 | 1.95 | 114 | 2.63 | 1.94 |

EXAMPLE 6

In this example the following parameters existed for Sample A, again the sample treated in accordance with the present invention:

| | |
|---|---|
| Temperature | 71° C. |
| Relative humidity | 65% |
| Treatment time | 3.0 min |
| Hardener level | 0.75x |

TABLE 7

| T | EL (mm) | Sample A BD | Sample A RD | EL (mm) | Sample B BD | Sample B RD |
|---|---|---|---|---|---|---|
| 0 | 105 | 2.70 | 1.96 | 56 | 2.73 | 1.94 |
| 1 | 106 | 2.70 | 1.96 | 78 | 2.70 | 1.92 |
| 2 | 107 | — | — | 92 | — | — |
| 4 | 108 | 2.70 | 1.96 | 100 | 2.67 | 1.90 |
| 7 | 111 | 2.69 | 1.96 | 112 | 2.65 | 1.89 |
| 20 | 114 | 2.69 | 1.95 | 114 | 2.65 | 1.89 |

In the following Example 7, the film being experimented with is KODACOLOR VR-G GOLD 100 which has the Kodak reference number 8095. The glass transition temperature of 8095 film is about 8 Centigrade degrees lower than that of the reference number 5097 film and is lower than most films. Therefore, lower temperatures were used in the reaction zone.

EXAMPLE 7

In this example the following parameters existed for Sample A, again the sample treated in accordance with the present invention:

| | |
|---|---|
| Temperature | 63° C. |
| Relative humidity | 70% |
| Treatment time | 3.0 min |
| Hardener level | 0.5x |

TABLE 10

| T | EL (mm) | Sample A BD | Sample A RD | EL (mm) | Sample B BD | Sample B RD |
|---|---|---|---|---|---|---|
| 0 | 39 | 2.92 | 1.90 | 40 | 3.04 | 1.90 |
| 1 | 39 | 2.92 | 1.90 | 64 | 3.03 | 1.88 |
| 2 | 39 | — | — | 78 | — | — |
| 4 | 39 | 2.91 | 1.90 | 84 | 3.02 | 1.86 |
| 7 | 40 | 2.91 | 1.90 | 92 | 3.01 | 1.85 |
| 20 | 40 | 2.91 | 1.90 | 94 | 3.01 | 1.84 |

It will be recognized that the advantages to be gained from adoption of the present invention include: the photographic material is in a condition immediately after being wound into a roll at the end of practice of the invention, in which the photographic characteristics of the material will not change materially due to ongoing formation of gelation cross-links. From this derives the advantage that the material can immediately be tested and certified without having to take account of variation in the material between testing and customer use. Also, the material can immediately be "finished", that is slit, cut and formed into rolls or sheets, and packaged, and marketed, without having to be stored for a period of weeks. This immediate finishing and subsequent marketing can be done with the sure knowledge that whether the material is used by the consumer, sooner or later, the photographic performance will be the same and as certified. Furthermore, varying aging effects due to differing position of a portion of the material in the roll are avoided. Also, there is reduced sensitivity to moisture variations during the time prior to use. Overall there is a massive reduction in inventory because the material does not have to be allowed to age before sale. Such reduction in inventory provides a major economy.

The invention has been described in detail with reference to presently preferred embodiments, but it will be understood that variations and modifications can be effected within the spirit and scope of the invention.

What we claim is:

1. A method of manufacturing a silver halide photographic material, including:
   providing a continuous web-like support;
   coating said support with a photographic composition including gelatin and hardener;
   drying the coating on the support;
   ensuring that the moisture content of the coating is sufficiently low that at temperatures subsequently to be encountered in the manufacturing method gelation cross-links will not be remelted and that the coating is less than 85 percent hardened;
   heating the coating in an atmosphere having a relative humidity sufficiently low as to avoid condensation on the coating;
   incubating the heated coating at a temperature of approximately the glass transition temperature or above and below the melting point of the coating, in an atmosphere having a relative humidity which causes a moisture content defined as weight of water/weight of gelatin of the coating of 0.1 to 0.25 for a period of time so that the coating is at least 85 percent hardened;
   cooling the support and coating; and
   winding the support with the coating thereon into a roll.

2. A method as claimed in claim 1, including the further steps, to be performed between the steps of drying and ensuring that the moisture content is sufficiently low:
   winding the coated and dried support into a roll; and unwinding the roll so formed.

3. A method as claimed in claim 1, wherein said step of ensuring that the moisture content of the coating is sufficiently low includes performing said step of drying until the surface of the coating is so dry that after termination of the drying step moisture migrating from the higher moisture content region of the coating adjacent the support causes regions at all depths into the coating away from the free surface to have a moisture content below that at which remelting of gelation cross-links would be induced in the ensuing incubation step.

4. A method as claimed in any one of the preceding claims, including, prior to winding up, reducing the moisture content of the coating so that it is in equilibrium with the atmosphere, ambient at the time of winding up, having a relative humidity of about 50%.

5. A method as claimed in claim 4, wherein the step of reducing the moisture content of the coating prior to winding up is performed by passing air over the coating.

6. A method as claimed in claim 5, wherein the air passed over the coating reduces the moisture content of the coating prior to winding up to between 0.1 and 0.2.

7. A method as claimed in claim 4, including the step of cooling the coating to a temperature below its glass transition temperature after the incubating step and before the step of reducing the moisture content so that it is in equilibrium with the atmosphere.

8. A method as claimed in claim 7, wherein the step of cooling the coating to a temperature below its glass transition temperature after the incubation step and before the step of reducing the moisture content, includes impinging air at ambient temperature and humidity onto the coating for about one to five seconds.

9. A method as claimed in claim 1, wherein the step of incubating the coating is performed at a temperature between the glass transition temperature of the coating and 5 centigrade degrees less than the melting point of the coating and at a relative humidity such as to cause a moisture content of the coating of 0.15 to 0.2.

10. A method of manufacturing a silver halide photographic material, including:

providing a roll of photographic material including a support coated with photographic composition including gelatin and hardener;

unwinding said roll;

ensuring that the coating of the unwound material has a moisture content sufficiently low that at temperatures subsequently to be encountered in the manufacturing method gelation cross-links will not be remelted and that the coating is less than 85 percent hardened;

heating the coating of the unwound material in an atmosphere having a relative humidity sufficiently low as to avoid condensation on the coating;

incubating the heated coating at a temperature of approximately the glass transition temperature or above the coating and below the melting point of the coating, in an atmosphere having a relative humidity which causes a moisture content defined as weight of water/weight of gelatin of the coating of 0.1 to 0.25 for a period of time so that the coating is at least 85 percent hardened;

cooling the support and coating; and winding the support with the coating thereon into a roll.

11. A method as claimed in claim 10, including reducing the moisture content of the coating so that it is in equilibrium with the atmosphere, ambient at the time of winding up, having a relative humidity of about 50%, prior to winding up.

12. A method as claimed in claim 11, wherein the step of reducing the moisture content of the coating prior to winding up is performed by passing air over the coating.

13. A method as claimed in claim 12, wherein the air passed over the coating in the step of reducing the moisture content of the coating prior to winding up has a relative humidity in the range of 10 to 20 percent.

14. A method as claimed in claim 11, including the step of cooling the coating to a temperature below its glass transition temperature after the incubating step and before the step of reducing the moisture content so that it is in equilibrium with the atmosphere.

15. A method as claimed in claim 14, wherein the step of cooling the coating to a temperature below its glass transition temperature after the incubation step and before the step of reducing the moisture content, includes impinging air at ambient temperature and humidity onto the coating for about one to five seconds.

16. A method as claimed in claim 10, wherein the step of incubating the coating is performed at a temperature between the glass transition temperature of the coating and 5 centigrade degrees less than the melting point of the coating and at a relative humidity such as to cause a moisture content of the coating of 0.15 to 0.2.

* * * * *